US006018969A

United States Patent [19]

Haseley et al.

[11] Patent Number: 6,018,969

[45] Date of Patent: Feb. 1, 2000

[54] LOCK CONSTRUCTION

[75] Inventors: Daryl R. Haseley, Orchard Park; Jeffery R. Sullivan, Boston, both of N.Y.

[73] Assignee: McGard, Inc., Orchard Park, N.Y.

[21] Appl. No.: 09/072,020

[22] Filed: May 4, 1998

[51] Int. Cl.[7] ..... E05B 9/08

[52] U.S. Cl. ..... 70/370; 70/161; 70/63; 70/461; 292/DIG. 60

[58] Field of Search ..... 70/370, 159, 160, 70/161, 162, 163, 164, 165, 166, 167, 168, 169, 229, 79, 63, 135, 139, 140, 461, 232; 411/150, 155, 149, 229, 231, 239; 292/DIG. 60, 202, 203, 204, 210

[56] References Cited

U.S. PATENT DOCUMENTS

| | | | |
|---|---|---|---|
| 1,458,520 | 6/1923 | Castell | 70/DIG. 13 |
| 2,453,492 | 11/1948 | Carter | 24/71 |
| 2,693,100 | 11/1954 | Wiegel | 70/389 |
| 3,089,330 | 5/1963 | Kerr | 70/140 |
| 3,418,833 | 12/1968 | Kerr | 70/389 |
| 3,519,979 | 7/1970 | Bodenstein | 70/404 |
| 4,143,530 | 3/1979 | Murtezov et al. | 70/165 |
| 4,342,208 | 8/1982 | Evans | 70/165 |
| 4,571,133 | 2/1986 | Lindow | 411/11 |
| 4,627,249 | 12/1986 | Dumortier | 70/139 |
| 4,823,571 | 4/1989 | O'Gara | 70/139 |
| 4,878,367 | 11/1989 | Bisbing | 70/491 |
| 5,119,653 | 6/1992 | Mazzotta | 70/58 |
| 5,412,960 | 5/1995 | James et al. | 70/63 |
| 5,413,392 | 5/1995 | Schlack et al. | 292/204 |
| 5,533,849 | 7/1996 | Burdick | 411/120 |
| 5,651,280 | 7/1997 | Park | 70/472 |
| 5,730,014 | 3/1998 | Berger et al. | 70/422 |
| 5,737,950 | 4/1998 | Yun-Bin | 70/379 R |
| 5,775,145 | 7/1998 | Kasper | 70/367 |

FOREIGN PATENT DOCUMENTS

| | | | |
|---|---|---|---|
| 1167899 | 12/1958 | France | 411/150 |

*Primary Examiner*—Darnell M. Boucher
*Assistant Examiner*—Clifford B. Vaterlaus
*Attorney, Agent, or Firm*—Joseph P. Gastel

[57] ABSTRACT

A lock including a lock housing, a lock bolt rotatably mounted in the lock housing, an undulating end on the lock housing, a torque plate mounted on the lock bolt for rotation therewith, an undulating face on the torque plate, and a spring mounted on the lock bolt and biasing the torque plate into engagement with the undulating end of the lock housing with the undulating face of the torque plate in meshing engagement with the undulating end of the lock housing. A bracket is mounted on the lock housing, first wings on the bracket, and a key having second wings for engagement with the first wings when the lock is in an unlocked condition.

19 Claims, 5 Drawing Sheets

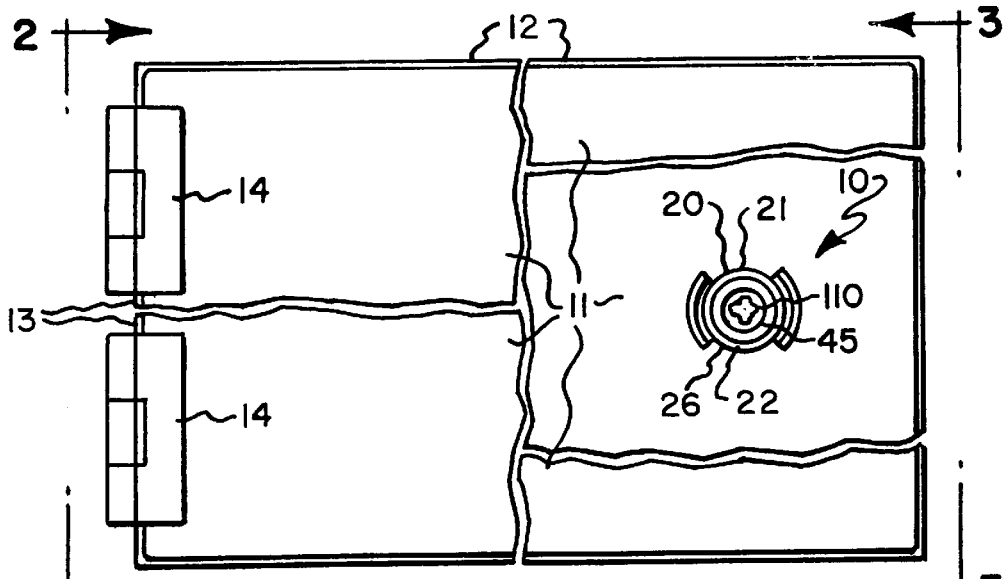
Fig. 1.
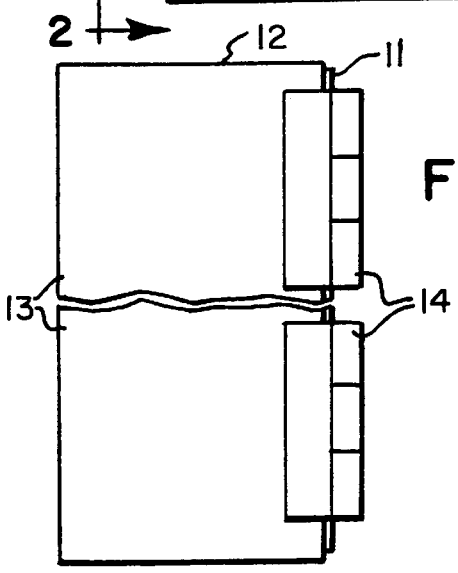
Fig. 2.
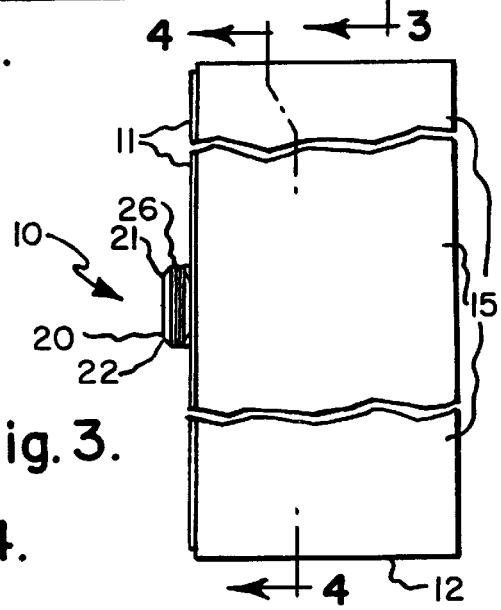
Fig. 3.
Fig. 4.
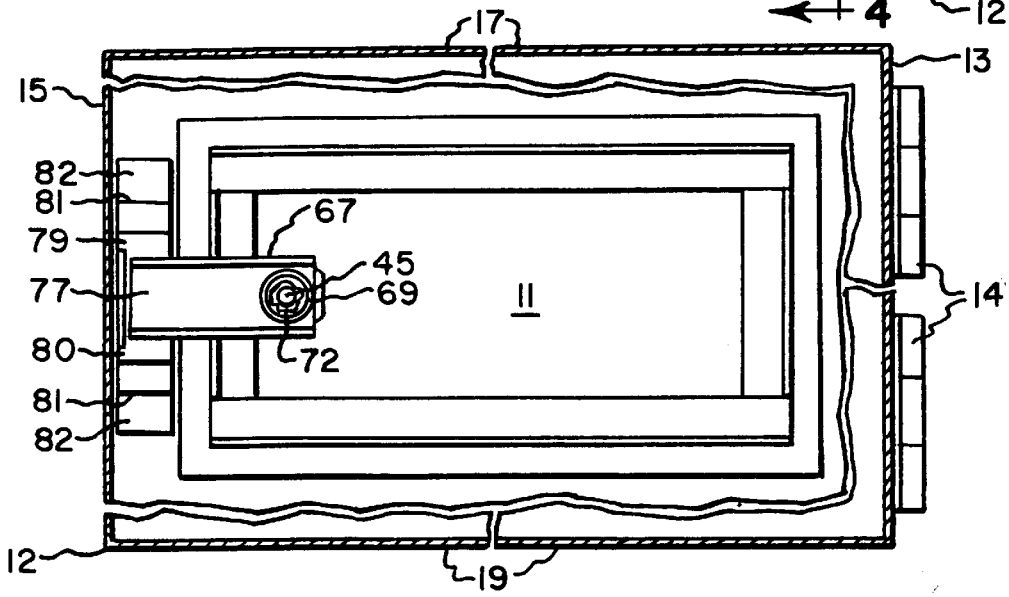

Fig. 18.
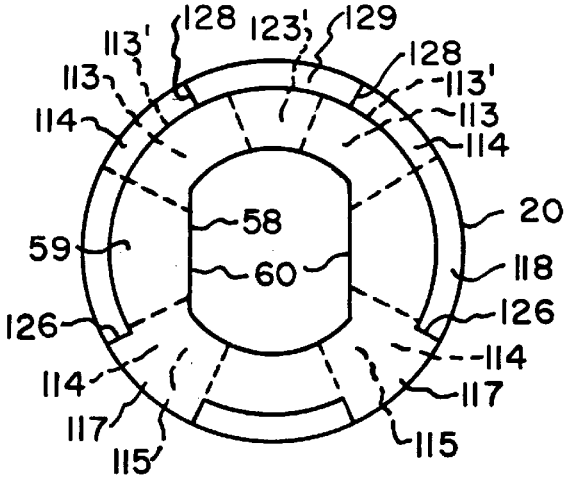
Fig. 20.
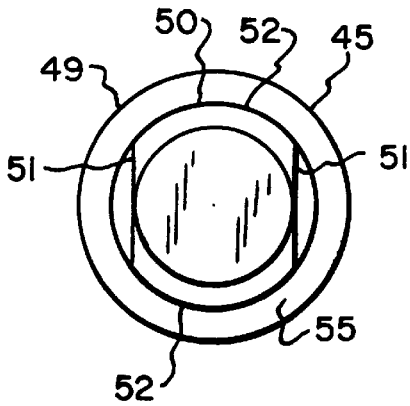
Fig. 19.
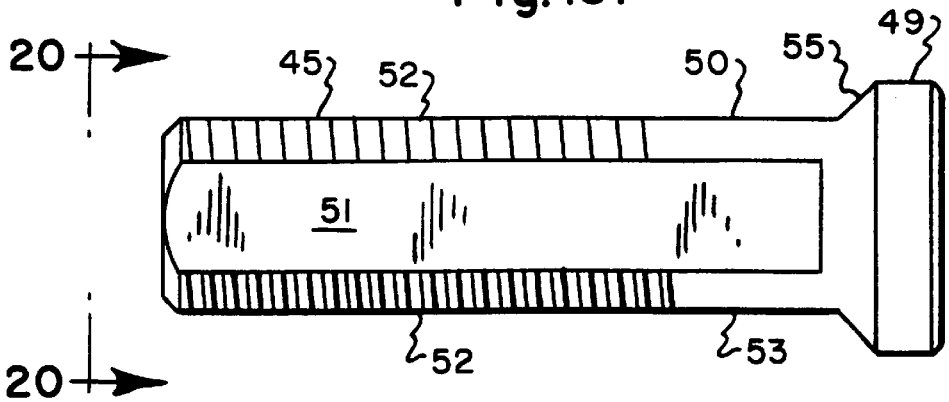
Fig. 7A.
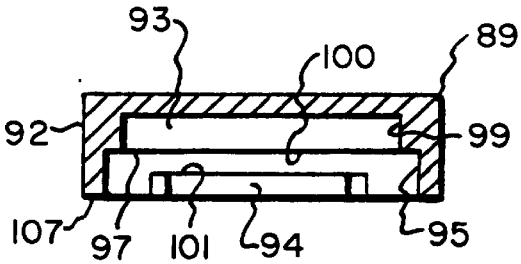
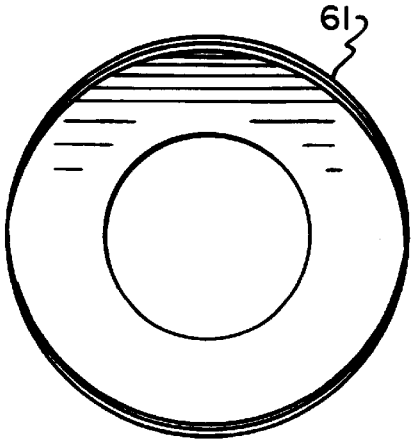
Fig. 21.

Fig. 8.
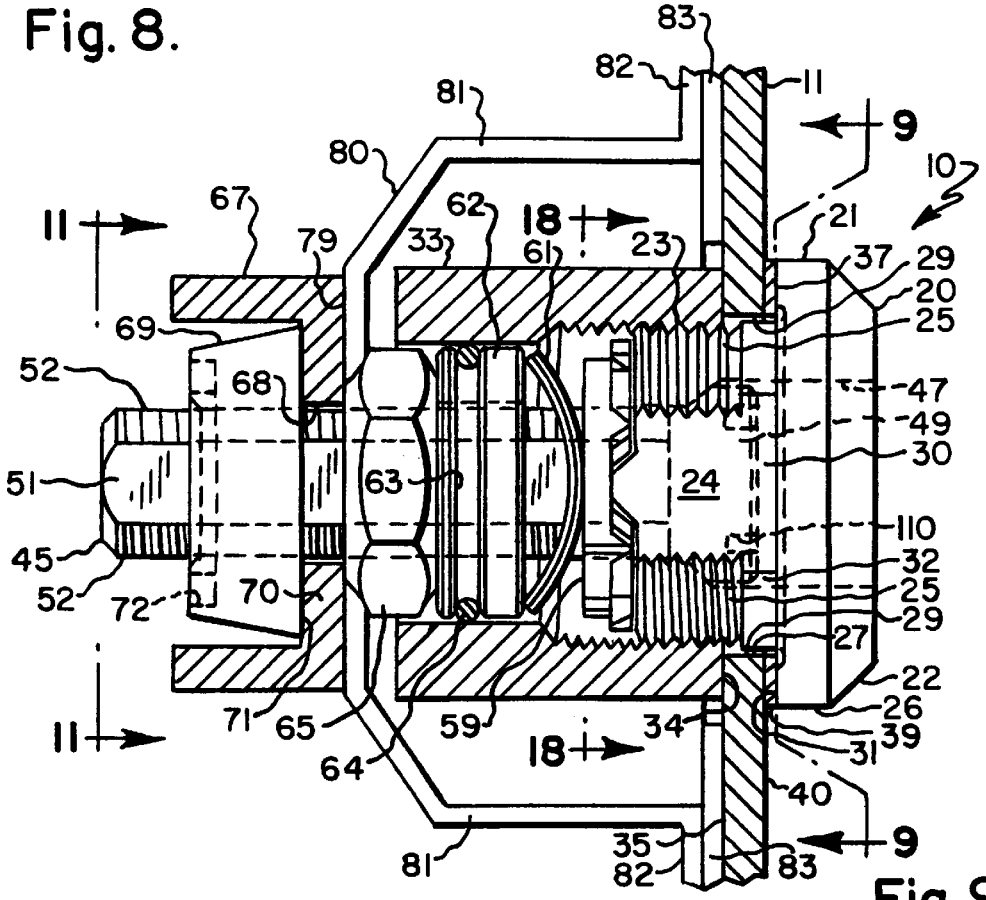
Fig. 9.
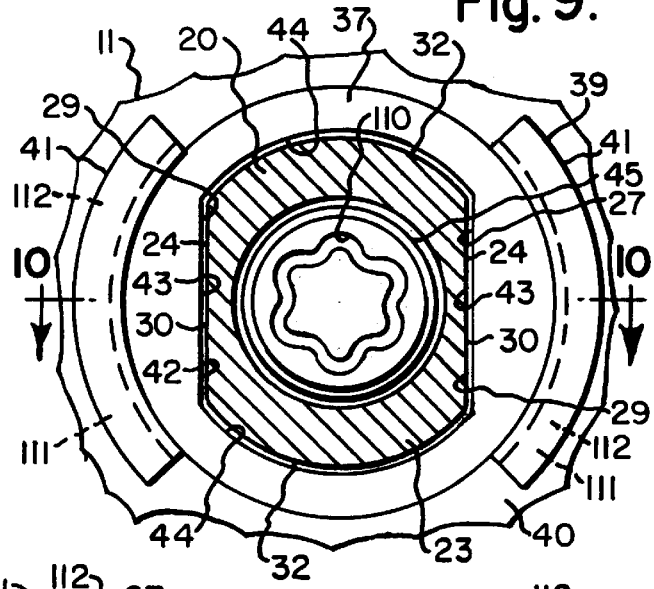
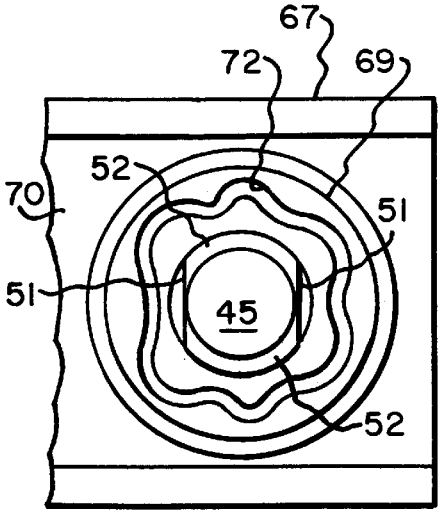
Fig. 11.
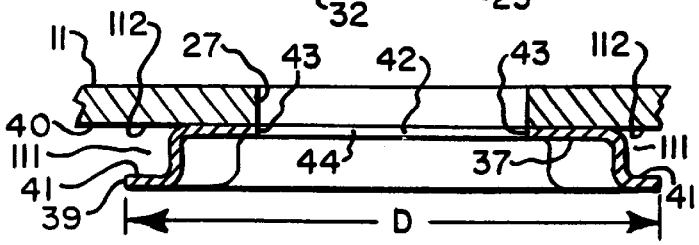
Fig. 10.

Fig. 15.
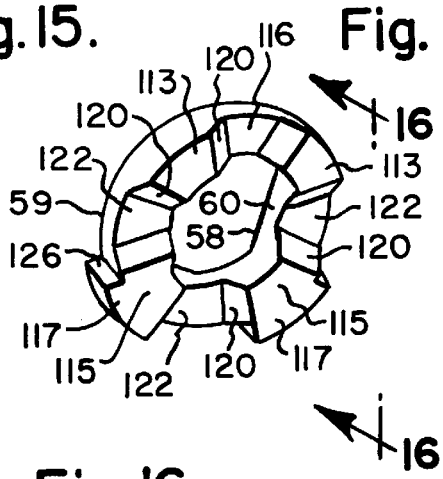
Fig. 12.
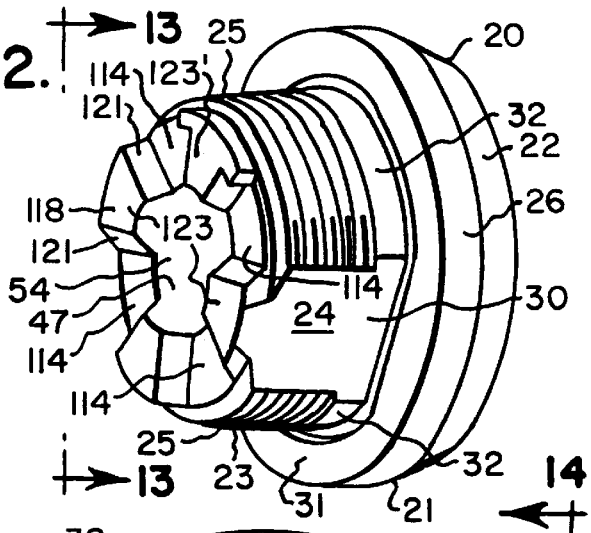
Fig. 16.
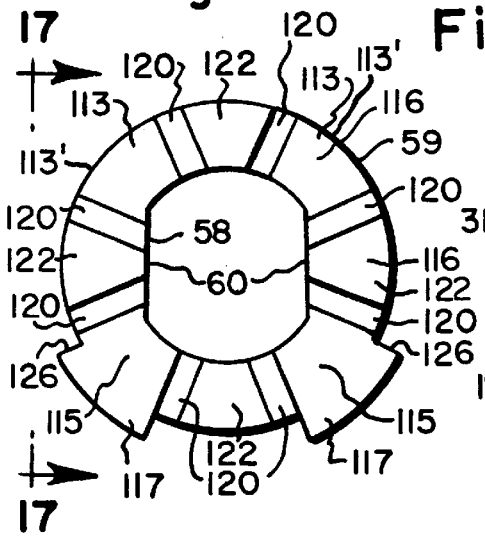
Fig. 13.
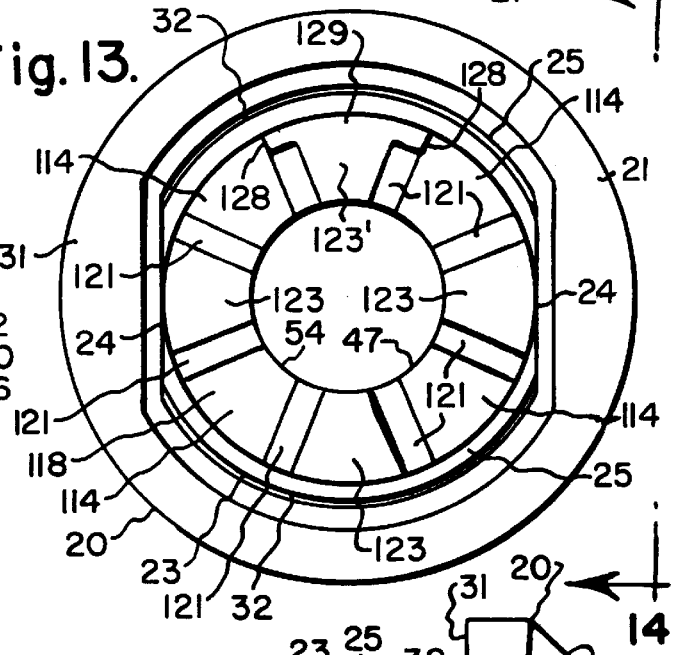
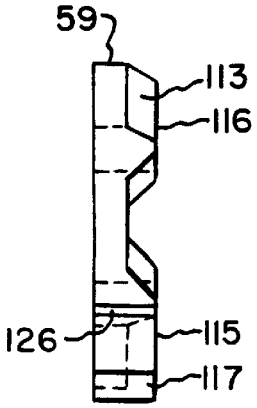
Fig. 17.
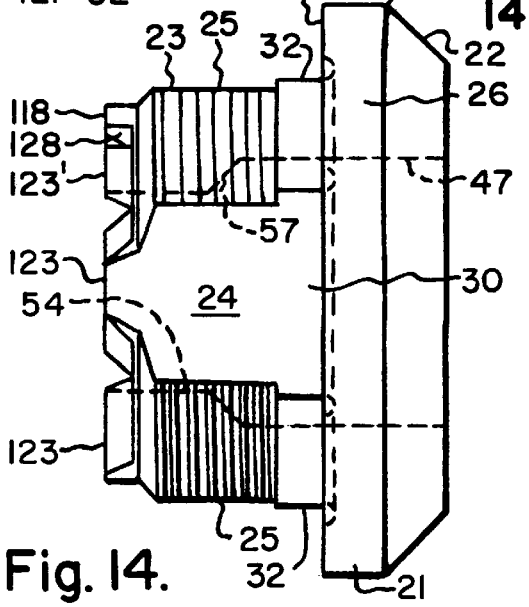
Fig. 14.

LOCK CONSTRUCTION

BACKGROUND OF THE INVENTION

The present invention relates to an improved lock construction for use on cabinet doors and the like.

By way of background, there are cabinets in use which house electrical circuitry. These cabinets have doors which require reliable locks which are capable of preventing unauthorized access. Furthermore, the cabinet lock should have a construction which requires the lock to be in a locked condition if the key for the lock is removed. Also, it is desirable that the lock require a substantial force to move it between locked and unlocked positions.

BRIEF SUMMARY OF THE INVENTION

It is one object of the present invention to provide an improved lock which requires a substantial torque to move it between locked and unlocked positions, thereby lessening the chance that the lock can be turned with other than an authorized key.

Another object of the present invention is to provide an improved lock in which the substantial torque required to move it between locked and unlocked positions is adjustable to meet different requirements.

Yet another object of the present invention is to provide an improved lock which cannot be disassembled except by the use of an authorized key.

A further object of the present invention is to provide an improved lock having a key construction which cannot be removed from mating engagement with the lock unless the lock is in a locking condition.

Yet another object of the present invention is to provide an improved lock having structure which restricts relative motion between its parts to positively retain it in either a locked or unlocked condition. Other objects and attendant advantages of the present invention will readily be perceived hereafter.

The present invention relates to a lock comprising a lock housing, a lock bolt rotatably mounted in said lock housing, an undulating end on said lock housing, a torque plate mounted on said lock bolt for rotation therewith, an undulating face on said torque plate, and a spring mounted on said lock bolt and biasing said torque plate into engagement with said undulating end of said lock housing with said undulating face of said torque plate in meshing engagement with said undulating end of said lock housing.

The present invention also relates to a lock and key therefor comprising a lock housing, a bracket having at least one first wing mounted on said lock housing, a lock bolt, a key-receiving head on said lock bolt within said lock housing, a key having a key portion for engaging said key-receiving head in an unlocked relationship, and at least one second wing on said key for effective engagement with said first wing when said key engages said lock bolt in an unlocked relationship.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 1 is a fragmentary side elevational view of a cabinet having the improved lock of the present invention mounted on the door thereof;

FIG. 2 is a fragmentary end elevational view taken substantially in the direction of arrows 2—2 of FIG. 1;

FIG. 3 is an end elevational view taken substantially in the direction of arrows 3—3 of FIG. 1;

FIG. 4 is a fragmentary cross sectional view taken substantially along line 4—4 of FIG. 3 and showing the flag of the lock in locking position;

FIG. 7A is a cross sectional view taken substantially along line 7A—7A of FIG. 6;

FIG. 8 is an enlarged fragmentary cross sectional view taken substantially along line 8—8 of FIG. 5 but showing the lock in assembled condition and in locking relationship with its holding bracket;

FIG. 9 is a fragmentary cross sectional view taken substantially along line 9—9 of FIG. 8 and showing the retaining bracket which retains the key in locked relationship with the door of the cabinet when the flag is in a door opening position;

FIG. 10 is a fragmentary cross sectional view taken substantially along line 10—10 of FIG. 9 and showing only the key retaining bracket and its associated door;

FIG. 11 is a fragmentary end elevational view taken substantially in the direction of arrows 11—11 of FIG. 8 and showing the locknut for retaining the various lock parts in assembled condition on the bolt of the lock;

FIG. 12 is a perspective view of the lock housing;

FIG. 13 is an end elevational view of the lock housing taken substantially in the direction of arrows 13—13 of FIG. 12;

FIG. 14 is a side elevational view of the lock housing taken substantially in the direction of arrows 14—14 of FIG. 13;

FIG. 15 is a perspective view of the torque plate;

FIG. 16 is an end elevational view of the torque plate taken substantially in the direction of arrows 16—16 of FIG. 15;

FIG. 17 is a side elevational view of the torque plate taken substantially in the direction of arrows 17—17 of FIG. 16;

FIG. 18 is a schematic view taken substantially in the direction of arrows 18—18 of FIG. 8 showing the torque plate superimposed over the end of the lock housing;

FIG. 19 is an enlarged side elevational view of the lock bolt;

FIG. 20 is an end elevational view of the lock bolt taken substantially in the direction of arrows 20—20 of FIG. 19; and FIG. 21 is an enlarged view of the spring of the lock.

DETAILED DESCRIPTION OF THE INVENTION

Figure 5:
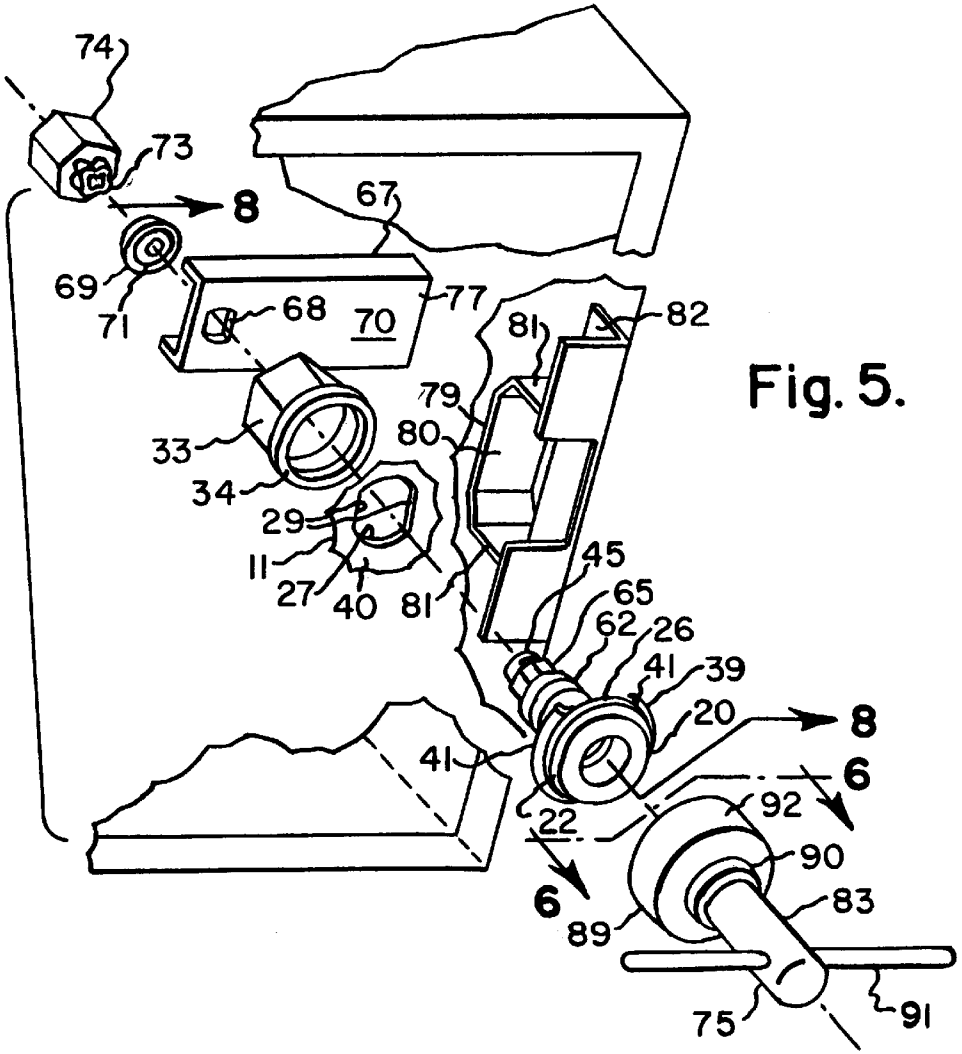
FIG. 5 is a fragmentary exploded perspective view of the improved lock, the key therefor, and the portion of the cabinet having the holding bracket thereon.

The lock 10 of the present invention is shown mounted on the door 11 of cabinet 12, door 11 being attached to end wall 13 by hinges 14. The cabinet also includes an end wall 15, side walls 17 and 19, and a rear wall (not shown). The cabinet 12 is intended to be an electric utility cabinet but may be of any desired type.

The lock 10 includes a lock housing 20 which has an annular lip 21 which includes a cylindrical portion 26 and an adjacent beveled edge 22. Lock housing 20 also includes a stem 23 which includes diametrically opposed flats 24 and diametrically opposed threaded portions 25. The stem 23 fits into a double-D aperture 27 (FIGS. 5, 8 and 9) in door 11, with the sides 29 of the double-D aperture lying adjacent portions 30 (FIGS. 8, 9, 12 and 14) of flats 24. Portions 30 are adjacent the rear face 31 of lip 21 and are diametrically opposed to each other between curved unthreaded portions 32. The portions 30 and 32 of stem 23 fit into complementary mating relationship with double-D aperture 27 so that lock housing 20 cannot rotate relative to door 11.

The lock housing 20 is secured on door 11 by jam nut 33 (FIGS. 5 and 8) which threads onto threads 25 of lock housing 20 and has annular end 34 which bears against the rear 35 of door 11. The flat annular portion 37 (FIGS. 9 and 10) of a key-retaining bracket 39 is clamped between the rear annular face 31 of lip 21 and the front surface 40 of door 11 with the diametrically opposed wings 41 of key-retaining bracket 39 being spaced from side 40 of door 11. The bracket 39 has a double-D aperture 42 (FIG. 9) with straight sides 43 between curved sides 44. The double-D aperture 42 fits in complementary mating relationship onto portions 30 and 32 of lock housing 20 so that the key-retaining bracket cannot rotate relative to lock housing 20 or to door 11.

A lock bolt 45 (FIGS. 8 and 19) is rotatably mounted within bore 47 (FIGS. 12 and 13) of lock housing 20. The lock bolt 45 includes a head 49 and a stem 50 which has diametrically opposed flats 51 and diametrically opposed threaded portions 52. The stem 50 also includes a cylindrical portion 53 which is rotatably received in cylindrical bore portion 54 (FIG. 14) of lock housing 20. The lock bolt 45 also includes a beveled annular shoulder 55 which bears against beveled annular shoulder 57 (FIG. 14) of lock housing 20 when lock bolt 45 is in its fully installed position within lock housing 20. As can be seen from FIG. 8, the head 49 of bolt 45 is recessed within lock housing 20 so that if an unauthorized tool is applied to groove 110 of bolt head 49, it has to have a low angle of attack relative to the bolt axis, which would be highly ineffectual for turning bolt 45.

When lock bolt 45 is in its fully installed position, a torque plate 59 (FIGS. 8, 15, 16, 17) is keyed to lock bolt 45. In this respect, the flats 60 (FIG. 16) of double-D aperture 58 of torque plate 59 are mounted adjacent the flats 51 of lock bolt 45 so that torque plate 59 will be keyed to pivot with lock bolt 45. A washer-type spring 61 is mounted on stem 50, and a washer 62 is also mounted on stem 50 on the opposite side of spring 61 from torque plate 59. Washer 62 has a groove 63 therein which receives an O-ring 64. A hex nut 65 threads onto stem 50 and bears against washer 62 which in turn bears against spring washer 61 which bears against torque plate 59. By adjusting the position of hex nut 65 on stem 50, the spring pressure of spring 61 against torque plate 59 may be adjusted to vary the torque required to turn bolt 45. The O-ring 64 and the mating fit between the various parts of the lock themselves, and between the lock and the cabinet, and between the hole 68 of the flag and the bolt stem 51 effectively seal the lock against the environment to prolong its life.

A flag 67 (FIGS. 4, 5 and 8) has a double-D aperture 68 therein which fits in complementary mating relationship onto the stem 50 of lock bolt 45 so that flag 67 will turn with lock bolt 45. A lock nut 69 is threaded onto stem 50 and clamps the web portion 70 of flag 67 between the face 71 of lock nut 69 and the end of hex nut 65. Lock nut 69 has an irregular groove 72 (FIG. 11) therein which receives a mating irregular ridge 73 (FIG. 5) of key 74. The ridge and groove keying arrangement is well known in the art. Unless a ridge which mates with groove 72 is used, lock nut 69 cannot be turned. The purpose of using a lock nut 69 which requires a key, such as 74, is to prevent the lock 10 from being disassembled and removed from the door 11 by unauthorized persons.

Figure 7:
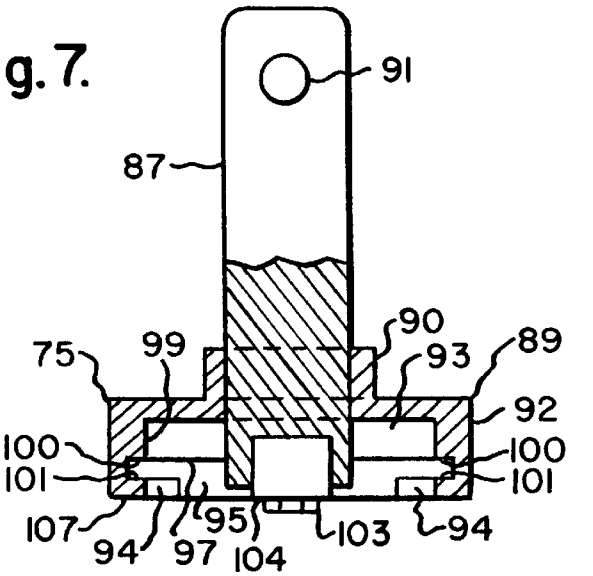
FIG. 7 is a fragmentary cross sectional view taken substantially along line 7—7 of FIG. 6.
Figure 6:
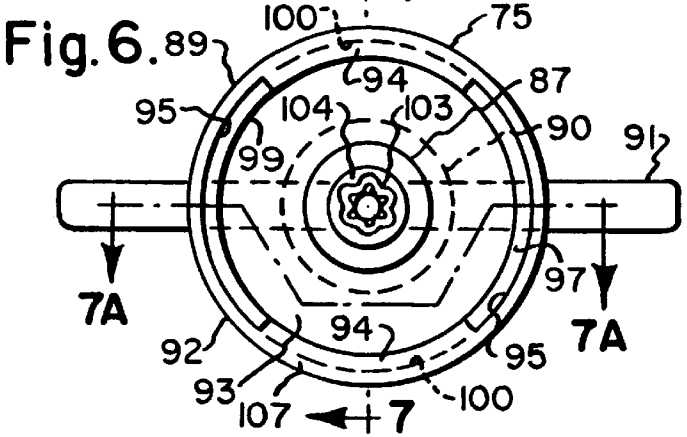
FIG. 6 is an enlarged end elevational view of the key of the present invention taken substantially in the direction of arrows 6—6 of FIG. 5.

A key 75 (FIGS. 5, 6 and 7) is utilized to actuate lock 10 to swing flag 67 between a locking position shown in FIG. 4 and an unlocking position wherein flag 67 is pivoted either clockwise or counterclockwise about 90° from its position shown in FIG. 4. In the locking position, the end 77 of flag 67 engages the rear side 79 (FIGS. 4 and 8) of bracket portion 80 which is essentially of U-shaped configuration having sides 81 (FIG. 8) which terminate at flanges 82 (FIGS. 4 and 8) which are adhesively secured to door 11 by double-sided adhesive pads 83, but may be secured by any other suitable means.

Key 75 includes a stem 87 (FIG. 7) onto which a cupped member 89 is nonrotatably secured at collar 90. A handle 91 is located at the end of stem 87. The cupped member 89 has a cylindrical side 92 which defines a chamber 93. A pair of wings 94 (FIGS. 6, 7 and 7A) extend inwardly from the internal surface 95 which terminates at shoulder 97. The inner diameter across wings 94 is the same as the inner diameter at internal cylindrical surface 99. There are grooves 100 between the rear sides 101 of wings 94 and shoulder 97. Essentially the internal surfaces 95 between wings 94 are undercut relative to the internal diameter of surface 99. Additionally, the internal diameter across surfaces 95 is slightly larger than the outer diameter D (FIG. 10) across wings 41 of retaining bracket 39.

The internal diameter across wings 94 of key 75 is slightly larger than the external diameter of cylindrical portion 26 of lip 20. Therefore, the wings 94 of cup member 89 can slide over cylindrical surface 26 of lip 20 when they are located between wings 41 of bracket 39, and they can move inwardly across cylindrical surface 26. At this time, the curvilinear ridge 103 (FIGS. 6 and 7), which projects outwardly beyond the edge 107 of cup member 89, will be aligned with and will enter groove 110 (FIG. 9) in the head 49 of lock bolt 45. Thereafter, key 75 can be turned by applying a rotational force to handle 91 until such time as the wings 94 of cup member 85 pass into grooves 111 (FIGS. 9 and 10) between the wings 41 of bracket 39 and the surface portions 112 of door 11. The foregoing will lock key 75 to door 11, and the handle 91 of key 75 can be pulled to open door 11 because at this time the flag 67 will have been moved out of engagement with holding bracket 79.

Before key 75 is rotated, that is, in the locked condition of lock 10, the protrusions 113 on the undulating face 116 of torque plate 59 will be biased by spring 61 into the upper two depressions 114 (FIG. 13) on the undulating end 118 of lock housing 20. Additionally, the entire protrusions 115 including extensions 117 (FIGS. 15 and 16) will be received in the lower two depressions 114 (FIG. 13) in the end 118 of lock housing 20. As can be seen from FIG. 18, the upper two protrusions 113 of torque plate 59 occupy only an inner portion of depressions 114 in the end 118 of lock housing 20. Also, the torque plate protrusions 115, which include extensions 117, occupy the entire lower two depressions 114 in the end 118 of lock housing 20. As can be seen from FIG. 18 (wherein torque plate 59 is superimposed over end 118 of lock housing 20, and from a measurement on FIGS. 13 and 16) the diameter of the face of torque plate exclusive of extensions 117 is smaller than the diameter of the end 118 of lock housing 20.

When the foregoing engagement between torque plate 59 and lock housing 20 is effected, the inclined surfaces 120 of protrusions 113 will be in engagement with the inclined surfaces 121 which border the depressions 114 of lock housing 20 which receive the protrusions 113 of torque plate 59. Also, when the foregoing engagement is effected, the recesses 122 of torque plate 59 will receive the protrusions 123 of lock housing 20. In other words, the face 116 of torque plate 59 and the end 118 of lock housing 20 will be in complementary mating relationship.

When torque plate 59 is rotated relative to the end 118 of housing 120 during the turning of key 75, the inclined surfaces 120 of torque plate 59 have to cam outwardly relative to the inclined surfaces 121 of protrusions 123 on the end of housing 20. This requires the axial movement of torque plate 59 on stem 50 of lock bolt 45 to be against the bias of spring 61. Furthermore, after the turning motion has been effected, the protrusions 113 and the protrusions 115 will enter grooves 114 which are adjacent to the grooves in which they were previously located, and when they enter such adjacent grooves, they will be retained therein because of the bias exerted by spring 61. In this position the face 116 of the torque plate and the end 118 of lock housing 20 will be in complementary mating relationship.

When torque plate 59 is rotated in either direction to place the lock in an unlocked position, one of the upper two protrusions 113 on torque plate 59 will wipe across the face of protrusion 123' on end 118 of lock housing 20 without contacting the extension portion 129 of protrusion 123' because, as can be seen from FIG. 18, the extreme outer surface 113' of each protrusion 113 lies inwardly of extension portion 129 of protrusion 123'. However, there is cooperating structure between the torque plate 59 and the end 118 of housing 20 which limits movement of lock bolt 45 and flag 67 keyed thereto to positions approximately 90° in either direction from its locked position shown in FIG. 4. This structure is shown in FIGS. 13, 16 and 18 and it comprises the protrusion extensions 117 on torque plate 59 having shoulders 126 which engage the shoulders 128 of portion 129 of protrusion 123' on lock housing end 118. In the foregoing respect, if a protrusion 115 on torque plate 59 should attempt to wipe across protrusion 123' on the end of lock housing 20, the shoulder 126 on extension 117 of a protrusion 115 will engage shoulder 128 of protrusion 123' to thereby prevent further movement. Thus, flag 67 cannot be rotated more than about 90° in either direction from its locked position.

It is to be noted that in both the locking position of torque plate 59, when it is in the position of FIGS. 16 and 18, and in the unlocking position of torque plate 59 when one of the two shoulders 126 engages a respective shoulder 128, the protrusions 113 and 115 on the torque plate are seated in the grooves 114 of the lock housing, and the protrusions 123 and 123' on the end 118 of the lock housing are seated in the grooves 122 of the torque plate. The torque which must be exerted on the key 75 to move the lock 10 between the above two positions, as noted above, depends on the adjustment of nut 65 which varies the compression of spring 61.

When it is desired to lock the cabinet door, it must first be closed and key 85 has to be rotated in a direction opposite to the direction which was used to move flag 67 away from its position of FIG. 4. This will cause the torque plate 59 to return to a position such as shown in FIG. 18 wherein extension portions 117 are at the bottom. At this time the wings 94 of key 75 will be out of grooves 111 (FIG. 10) and will be adjacent surfaces 109 between wings 41 of retaining bracket 39 so that the key 85 can be moved away from door 11.

While double-D shapes have been used to effect a keying relationship between various parts, it will be appreciated that other types of keying shapes or devices may be used. Also, while the undulating faces 116 and 118 of torque plate 59 and housing 20, respectively, have been shown as being integral therewith, it will be appreciated that other types of interacting undulating relationships or detents may also provide the desired results.

It can thus be seen that the lock arrangement of the present invention is manifestly capable of achieving the above-enumerated objects, and while preferred embodiments of the present invention have been disclosed, it will be appreciated that it is not limited thereto but may be otherwise embodied within the scope of the following claims.

What is claimed is:

1. A lock comprising a lock housing, a lock bolt rotatably mounted in said lock housing, an undulating end on said lock housing, a jam nut mounted on said lock housing, an end portion on said jam nut which extends beyond said undulating end of said lock housing and defines a chamber, a torque plate mounted on said lock bolt within said chamber for rotation with said lock bolt, an undulating face on said torque plate, a spring mounted on said lock bolt within said chamber, a nut mounted on said lock bolt and effectively bearing against said spring for biasing said torque plate into engagement with said undulating end of said lock housing with said undulating face of said torque plate in meshing engagement with said undulating end of said lock housing, a washer within said chamber mounted between said nut and said spring, said chamber including a wall, and an O-ring mounted on said washer and positioned in engagement with said wall.

2. A lock as set forth in claim 1 including a flag mounted on said lock bolt for rotation therewith.

3. A lock as set forth in claim 2 including a lock nut mounted on said lock bolt on the opposite side of said flag from said lock housing.

4. A lock as set forth in claim 3 wherein said lock bolt includes a head, and a key-receiving face on said head.

5. A lock as set forth in claim 4 wherein said key-receiving face is located within said lock housing.

6. A lock as set forth in claim 1 wherein said lock bolt includes a head, and a key-receiving face on said head.

7. A lock as set forth in claim 6 wherein said key-receiving face is located within said lock housing.

8. A lock comprising a lock housing, a lock bolt rotatably mounted in said lock housing, an undulating end on said lock housing, a jam nut mounted on said lock housing, an end portion on said jam nut which extends beyond said undulating end of said lock housing and defines a chamber, a torque plate mounted on said lock bolt within said chamber for rotation with said lock bolt, an undulating face on said torque plate, a spring mounted on said lock bolt within said chamber, a nut mounted on said lock bolt and effectively bearing against said spring for biasing said torque plate into engagement with said undulating end of said lock housing with said undulating face of said torque plate in meshing engagement with said undulating end of said lock housing, said spring being a washer-type spring, a washer mounted between said nut and said washer-type spring within said chamber, said chamber including a wall, and an O-ring mounted on said washer and positioned in engagement with said wall.

9. A lock as set forth in claim 8 wherein said lock bolt includes a head, and a key-receiving face on said head.

10. A lock as set forth in claim 9 wherein said key-receiving face is located within said lock housing.

11. A lock as set forth in claim 10 wherein said key-receiving head includes a curvilinear groove in said face.

12. A lock as set forth in claim 8 including a flag mounted on said lock bolt for rotation therewith.

13. A lock as set forth in claim 12 including a lock nut mounted on said lock bolt on the opposite side of said flag from said lock housing.

14. A lock as set forth in claim 13 wherein said lock bolt includes a head, and a key-receiving face on said head.

15. A lock as set forth in claim 14 wherein said key-receiving face is located within said lock housing.

16. A lock comprising a lock housing, a lock bolt rotatably mounted in said lock housing, an undulating end on said lock housing, a jam nut mounted on said lock housing, an end portion on said jam nut which extends beyond said undulating end of said lock housing and defines a chamber, a torque plate mounted on said lock bolt within said chamber for rotation with said lock bolt, an undulating face on said torque plate, a spring mounted on said lock bolt within said chamber, a nut mounted on said lock bolt and effectively bearing against said spring for biasing said torque plate into engagement with said undulating end of said lock housing with said undulating face of said torque plate in meshing engagement with said undulating end of said lock housing, at least one first protrusion on said undulating end of said housing, at least one second protrusion on said torque plate for engaging said first protrusion to limit relative rotation therebetween, a washer within said chamber mounted between said nut and said spring, said chamber including a wall, and an O-ring mounted on said washer and positioned in engagement with said wall.

17. A lock as set forth in claim 16 including a flag mounted on said lock bolt for rotation therewith.

18. A lock as set forth in claim 17 including a lock nut mounted on said lock bolt on the opposite side of said flag from said lock housing.

19. A lock as set forth in claim 18 wherein said lock bolt includes a head, and a key-receiving face on said head located within said housing.

* * * * *